United States Patent [19]

Higashi

[11] Patent Number: 4,638,560

[45] Date of Patent: Jan. 27, 1987

[54] SAFETY RAZOR

[75] Inventor: Kanji Higashi, Omochanomachi, Japan

[73] Assignee: Kabushiki Kaisha Bandai, Japan

[21] Appl. No.: 840,078

[22] Filed: Mar. 17, 1986

[30] Foreign Application Priority Data

Oct. 17, 1985 [JP] Japan ..... 60-231758

[51] Int. Cl.[4] ..... B26B 21/00

[52] U.S. Cl. ..... 30/47; 30/87

[58] Field of Search ..... 30/47, 87, 151, 153, 30/85

[56] References Cited

U.S. PATENT DOCUMENTS 1,966,307 7/1934 Ohmer ..... 30/47

2,010,304 8/1935 Hyatt ..... 30/47

*Primary Examiner*—Douglas D. Watts

*Attorney, Agent, or Firm*—R. Gale Rhodes, Jr.

[57] ABSTRACT

A safety razor includes a holding member for holding a razor blade; a pair of shaft members rotatably connected to the rear side of the holding members opposite to the razor blade; and a pair of cover members each slidably connected to a corresponding one of the shaft members for covering the holding member when the said shaft members are moved substantially in parallel with the holding member.

3 Claims, 4 Drawing Figures

SAFETY RAZOR

BACKGROUND OF THE INVENTION

1. Field of the Invention

The present invention relates to a safety razor and more particularly to the construction of the safety razor improving safety and portability.

2. Description of the Prior Art

A known safety razor is mainly constructed of a holding member for holding a razor blade and a rod formed integrally with the holding member or mechanically coupled thereto such as by threading. The rod extends substantially vertically to the longitudinal direction of the holding member and centrally from the rear side of the holding member opposite to the razor blade, thus forming generally a T-shaped outer appearance. This T-shaped outer appearance, however, involves some problems that the overall dimension of the safety razor becomes large and it is not handy for carrying it. Furthermore, since the razor blade is always exposed outwardly, it is necessary while not using it for the purpose of safety to additionally provide a removable protection cover or to prepare a case sufficiently large for accommodating the safety razor.

SUMMARY OF THE INVENTION

The present invention has been made in consideration of the above prior art problems and has its object to provide a safety razor having the construction improving safety and portability.

According to one aspect of the present invention, the safety razor comprises a holding member for holding a razor blade; a pair of shaft members rotatably connected to the rear side of said holding member opposite to said razor blade; and a pair of cover members each slidably connected to a corresponding one of said shaft members for covering said holding member when said shaft members are moved substantially in parallel with said holding member. With such construction, it is possible to rotate both the shaft members and cover members slidably coupled thereto. While using, the cover members are positioned perpendicularly to the longitudinal direction of the holding member to make the former as a handle of the safety razor. While not using, the cover members are positioned substantially in parallel with the longitudinal direction of the holding member to make the former serve as a protection cover for the razor blade.

The above and other objects of the present invention will become apparent from the following description when taken in conjunction with the accompanying drawings.

DETAILED DESCRIPTION OF THE PREFERRED EMBODIMENT

Figure 1:
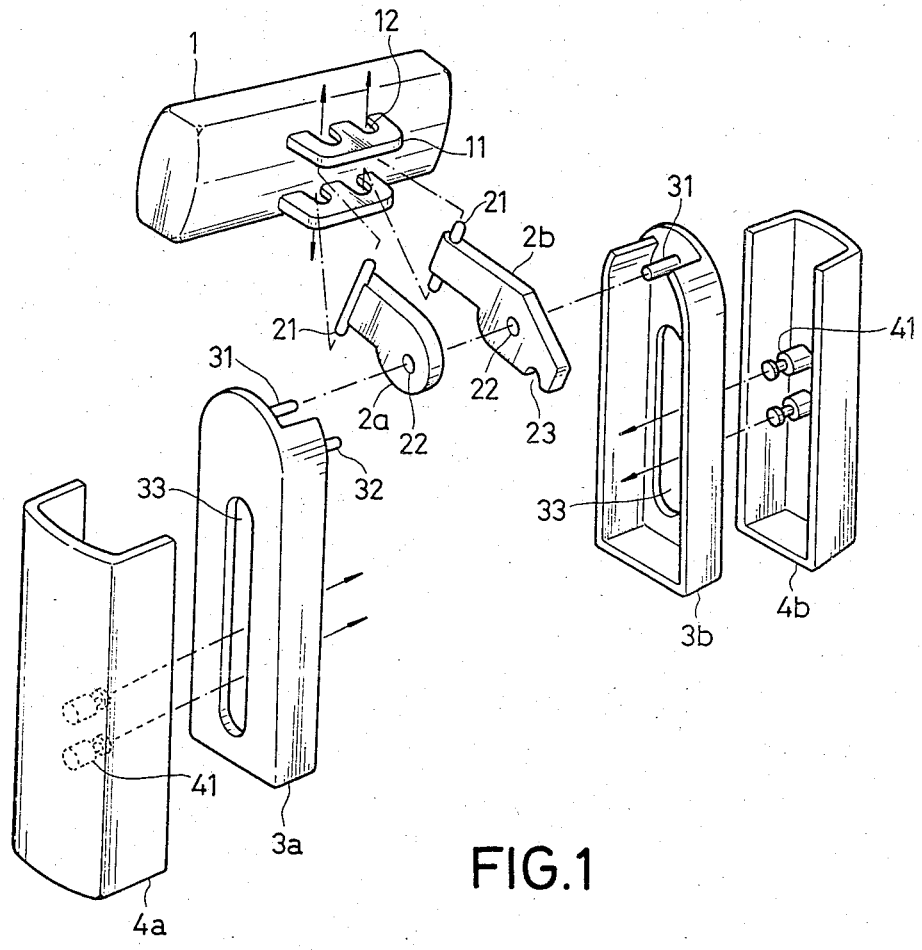
FIG. 1 is a perspective, exploded view showing an embodiment of the safety razor according to the present invention.

The present invention will now be described in detail with reference to the preferred embodiment. FIG. 1 is a perspective, exploded view showing an embodiment of the safety razor according to the present invention. In the figure, reference numeral 1 represents a holding member for holding a razor blade (not show. The holding member 1 is generally of a box shape. The construction thereof is not directly relevant to the gist of the present invention so that the detailed description therefor is here omitted. Generally centrally of the rear side of the holding member 1 opposite to the side where a razor blade is held, a pair of right and left shaft members, including first shaft members 2*a* and 2*b* and second shaft members 3*a* and 3*b* are coupled rotatably to bearing members 11 and 11. More in particular, the bearing members 11 each formed with elongated holes 12 extend from the rear side of the holding member 1, both bearing members 11 being mounted with a certain interval therebetween. The right and left first shaft members 2*a* and 2*b* are each formed with protrusions 21 by which the first shaft members are rotatably coupled to the bearing members 11. Each of the first shaft member 2*a*, 2*b* is also formed with a hole 22 into which a coupling rod 31 formed on each of the second shaft members 3*a* and 3*b* is inserted to ensure a coupling between the first shaft member 2*a*, 2*b* and second shaft member 3*a*, 3*b*. The right side first shaft member 2*b* is formed with a recess 23 which can engage with a rod 32 protruded from a left side second shaft member 3*a* while using the safety razor. The relative position of the first and second shaft members 2*a*, 2*b*, 3*a* and 3*b* is fixed as will be described later. A pair of cover members 4*a* and 4*b* are constructed such that they can slidable relative to the second shaft members 3*a* and 3*b* and cover the outer surfaces of the second shaft members 3*a* and 3*b*. The slide connection therebetween is effected by the provision of elongated apertures 33 and 33 formed in the second shaft members 3*a* and 3*b* and engaging members 41 and 41 formed on the cover members 4*a* and 4*b*. The top ends of the engaging members 41 slide along the inner surfaces adjacent the elongated apertures 33 of the second shaft members, as shown particularly in FIGS. 2 and 3. The cover members 4*a* and 4*b* are constructed to have sufficient dimensions for covering also the holding member 1. The lengths of the second shaft members 3*a* and 3*b* as well as the cover members 4*a* and 4*b* are so determined as they are suitable for holding the cover members 4*a* and 4*b* serving as the handle of the safety razor. Materials of the elements are preferably synthetic resin. The arrows shown in FIG. 1 indicate how the safety razor is assembled using such as adhesive agent or other suitable means.

Figure 2:
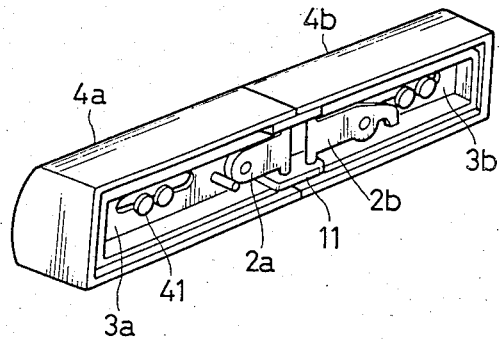
FIG. 2 is a perspective view of the safety razor with cover members covering the holding member.

The operation of the safety razor constructed as above will be described herinunder. First, while the safety razor is not used, it can be folded together as shown in FIG. 2. In particular, the right and left shaft members including the first and second shaft members 2*a*, 2*b*, 3*a* and 3*b* are exploded to the right and left side by rotating them around the protrusions 21 and 21 toward the holding member 1. Thereafter, each of the cover members 4*a* and 4*b* is slidably moved to the midst of the holding member 1 to fully cover it, thus folding the safety razor to become substantially of a straight line shape.

Figure 3:
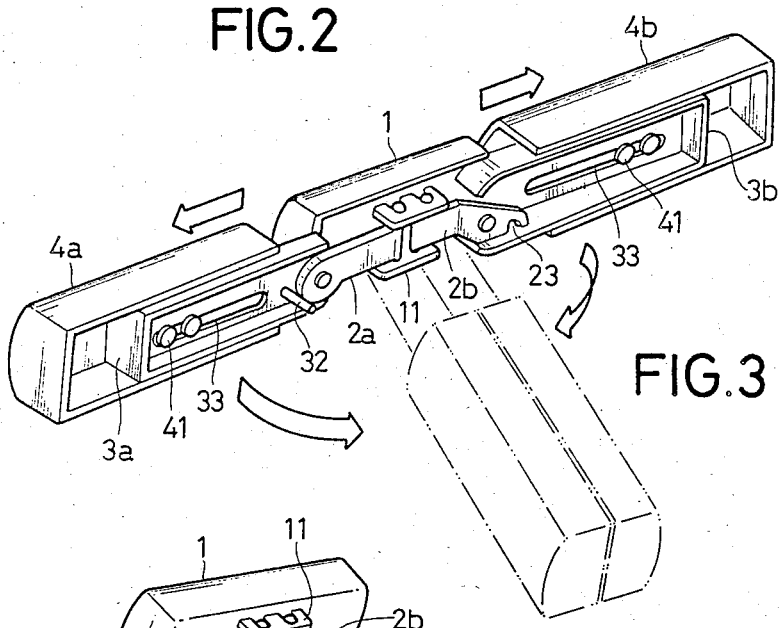
FIG. 3 is a perspective view showing an intermediate state during assembling the safety razor.
Figure 4:
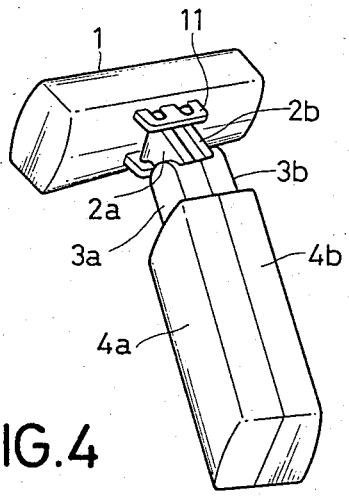
FIG. 4 is a perspective view of the safety razor with cover members displaced from the holding member to make the former serve as a handle of the safety razor.

Next, to use the safety razor, the cover members 4*a* and 4*b* are pulled outward as shown by arrows of FIG. 3 to expose the holding member 1. Thereafter, the cover members 4*a* and 4*b* together with the right and left shaft members 2*a*, 2*b*, 3*a* and 3*b* are rotated about the protrusions 21 and 21 to position them approximately at the right angle relative to the longitudinal direction of the holding member 1. As a result, the cover members 4*a* and 4*b* abut against each other to form a safety razor outer appearance of a T-shape. In this state, the cover members 4*a* and 4*b* serving as the handle of the safety razor can be held with ease. In addition, in this state, the recess 23 formed in the right side first shaft member 2*b* engages with the rod 32 formed on the left side shaft member 3*a* to fix the mutual position of the first and second shaft members 2*a*, 2*b*, 3*a* and 3*b*. A space between the elongated hole 12 formed in the bearing member 11 and the protrusion 21 permits a slight back and front movement of the holding member 1 relative to the first shaft members 2*a* and 2*b*, thus facilitating a shaving operation.

The bearing construction including the bearing members 11 and the protrusions 21 for rotatably coupling the holding member 1 and the right and left shaft members is not limited to the above embodiment, but various modifications are possible. For example, the mutual mounting position between the bearing members and the protrusions may be reversed, or another bearing construction including balls and spherical recesses rotatably coupling to the balls may be used. As to the slide engagement between the engaging members 41 and 41 and the right and left side second shaft members 3*a* and 3*b*, it is apparent that the mutual position therebetween may be reversed. The slide engagement is not limited to only the above embodiment, but various modifications are possible. For example, a slide engagement with a guide rail and a follower may also be used.

As described so far, according to the safety razor of the present invention, the cover members together with the shaft members are positioned perpendicularly to the holding member, thereby constructing the safety razor as of a T-shape similar to the conventional one and enabling securely holding with hand the cover members serving as a handle. Furthermore, while not using, the cover members together with the shaft members are positioned substantially in parallel with the holding member so that the safety razor can be folded in a straight line shape and also the holding member can be covered with the cover members. Therefore, a razor blade can be shielded with the cover members, thus ensuring a safety of carrying the safety razor. In addition, a separate protection cover or a large case as used heretofore is not necessary. Since the safety razor of this invention can be folded, the overall dimension is small thus realizing a compact safety razor with a high portability.

Although the present invention has been described with reference to the particular embodiment, the present invention is not limited thereto. Various other changes and modifications may be made within the spirit and scope of the present invention.

What is claimed is:

1. A safety razor comprising: a holding member for holding a razor blade; a pair of shaft members rotatably connected to the rear side of said holding member opposite to said razor blade; a pair of cover members each slidably connected to a corresponding one of said shaft members for covering said holding member when said shaft members are moved substantially in parallel with said holding member; and wherein said pair of shaft members each include first and second shaft members, said first shaft member being rotatably connected to the rear side of said holding member and said second shaft member being rotatably coupled to said first shaft member, wherein said cover members are each slidably connected to said second shaft member.

2. A safety razor according to claim 1, wherein a coupling between said holding member and said first shaft member is effected by use of bearing members mounted on said rear side of said holding member and protrusions formed on one ends of said first shaft members.

3. A safety razor according to claim 1, wherein a slide coupling between said second shaft member and said cover member is effected by use of an elongated aperture formed in said second shaft member and at least one engaging member mounted on said cover member.

* * * * *